United States Patent [19]

Eakman et al.

[11] 4,211,669

[45] Jul. 8, 1980

[54] PROCESS FOR THE PRODUCTION OF A CHEMICAL SYNTHESIS GAS FROM COAL

[75] Inventors: James M. Eakman, Houston, Tex.; Harry A. Marshall, Madison; Theodore Kalina, Morris Plains, both of N.J.

[73] Assignee: Exxon Research & Engineering Co., Florham Park, N.J.

[21] Appl. No.: 959,266

[22] Filed: Nov. 9, 1978

[51] Int. Cl.[2] ..... C01B 2/14; C01B 2/16; C01B 2/02

[52] U.S. Cl. ..... 252/373; 48/197 R; 48/214 A

[58] Field of Search ..... 252/373; 48/197 R, 214 A

[56] References Cited

U.S. PATENT DOCUMENTS

| | | | |
|---|---|---|---|
| 4,094,650 | 6/1978 | Koh et al. | 48/214 A |
| 4,118,204 | 10/1978 | Eakman et al. | 48/197 R |

*Primary Examiner*—Howard T. Mars
*Attorney, Agent, or Firm*—Yale S. Finkle

[57] ABSTRACT

A high purity chemical synthesis gas is produced by reacting steam with a carbonaceous feed material in the presence of a carbon-alkali metal catalyst and substantially equilibrium quantities of added hydrogen and carbon monoxide at a temperature between about 1000° F. and about 1500° F. and a pressure in excess of about 100 psia to produce a raw product gas consisting essentially of equilibrium quantities, at reaction temperature and pressure, of methane, steam, carbon dioxide, carbon monoxide and hydrogen; withdrawing the raw product gas from the gasifier and treating it for the removal of steam and acid gases to produce a treated gas containing primarily carbon monoxide, hydrogen and methane; recovering carbon monoxide and hydrogen from the treated gas as a chemical synthesis product gas; mixing the remainder of the treated gas consisting essentially of methane with steam; passing the resultant mixture into a steam reforming furnace where the methane reacts with the steam to produce carbon monoxide and hydrogen; and passing the effluent from the reforming furnace into the gasifier.

11 Claims, 1 Drawing Figure

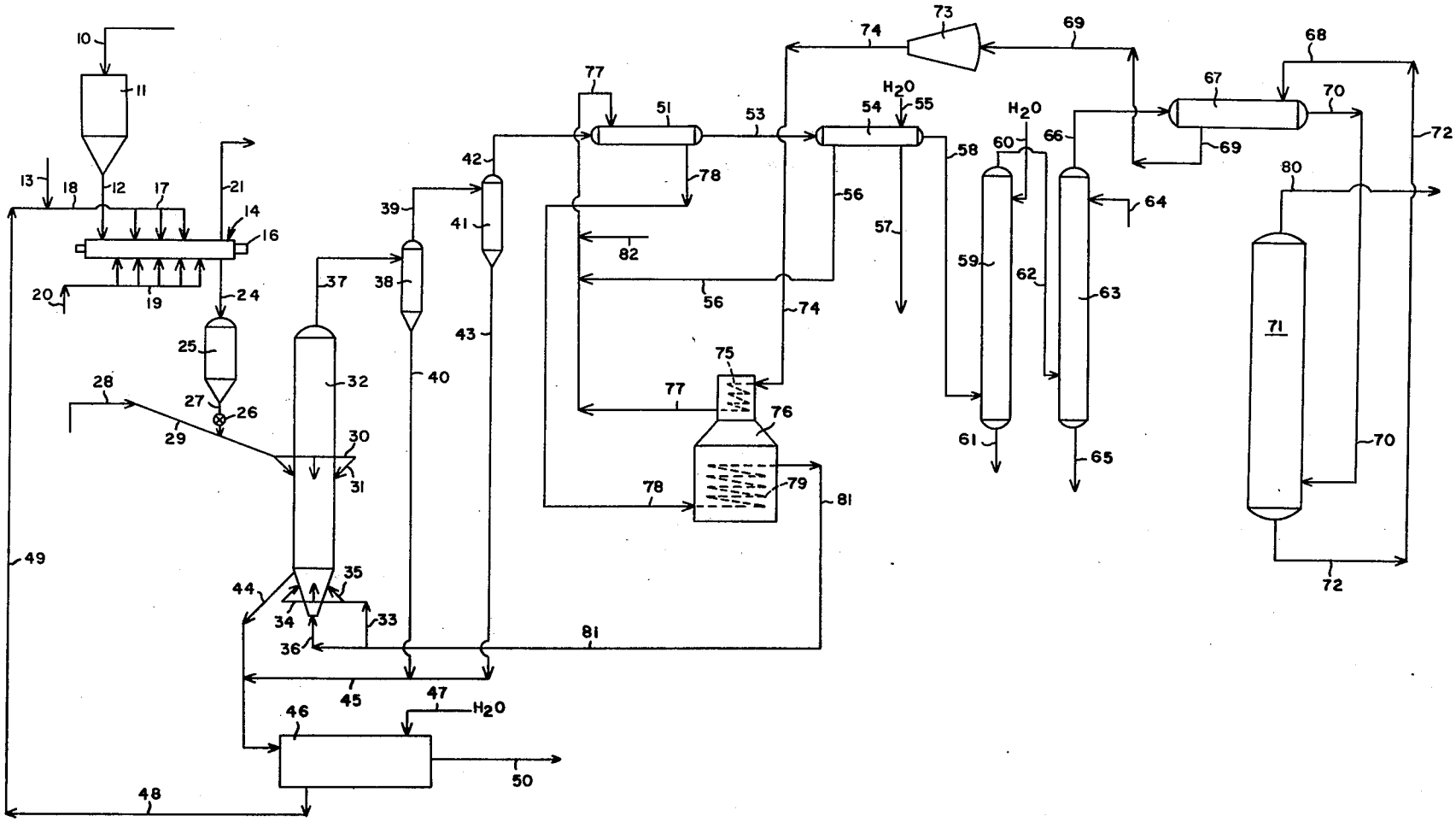
$H_2O$
$H_2O$
$H_2O$

PROCESS FOR THE PRODUCTION OF A CHEMICAL SYNTHESIS GAS FROM COAL

BACKGROUND OF THE INVENTION

1. Field of the Invention

This invention relates to the gasification of coal and similar carbonaceous materials and is particularly concerned with a catalytic gasification process carried out in the presence of a carbon-alkali metal catalyst to produce a chemical synthesis gas.

2. Description of the Prior Art

Existing and proposed processes for the manufacture of synthetic gaseous fuels from coal or similar carbonaceous materials normally require the reaction of carbon with steam, alone or in combination with oxygen, at temperatures between about 1200° F. and about 2500° F. to produce a gas which may contain some methane but consists primarily of hydrogen and carbon monoxide. This gas can be used directly as a synthesis gas or a fuel gas with little added processing or can be reacted with additional steam to increase the hydrogen-to-carbon monoxide ratio and then fed to a catalytic methanation unit for reaction with carbon monoxide and hydrogen to produce methane. It has been shown that processes of this type can be improved by carrying out the initial gasification step in the presence of a catalyst containing an alkali metal constituent. The alkali metal constituent accelerates the steam-carbon gasification reaction and thus permits the generation of synthesis gas at somewhat lower temperatures than would otherwide be required. Processes of this type are costly because of the large quantities of heat that must be supplied to sustain the highly endothermic steam-carbon reaction. One method of supplying this heat is to inject oxygen directly into the gasifier and burn a portion of the carbon in the feed material being gasified. This method is highly expensive in that it requires the existence of a plant to manufacture the oxygen. Other methods for supplying the heat have been suggested, but these, like that of injecting oxygen, are expensive.

It has been recently found that difficulties associated with processes of the type described above, can largely be avoided by carrying out the reaction of steam with carbon in the presence of a carbon-alkali metal catalyst and substantially equilibrium quantities of added hydrogen and carbon monoxide. Laboratory work and pilot plant tests have shown that catalysts produced by the reaction of carbon and alkali metal compounds such as potassium carbonate to form carbon-alkali metal compounds or complexes will, under the proper reaction conditions, equilibrate the gas phase reactions occurring during gasification to produce methane and at the same time supply substantial amounts of exothermic heat within the gasifier. This additional exothermic heat of reaction essentially balances the overall endothermicity of the reactions involving solid carbon and thus results in a substantially thermoneutral process in which the injection of large amounts of oxygen or the use of other expensive methods of supplying heat are eliminated.

The catalytic effect of carbon-alkali metal catalysts on the gas phase reactions, as distinguished from the solid-gas reactions or the reactions of carbon with steam, hydrogen or carbon dioxide, allows the following exothermic reactions to contribute substantially to the presence of methane in the effluent gas and drastically reduces the endothermicity of the overall reaction:

(1) $2CO+2H_2 \rightarrow CO_2+CH_4$ (exothermic)

(2) $CO+3H_2 \rightarrow H_2O+CH_4$ (exothermic)

(3) $CO_2+4H_2 \rightarrow 2H_2O+CH_4$ (exothermic)

Under the proper operating conditions, these reactions can can be made to take place within the gasification zone and supply large amounts of methane and additional exothermic heat which would otherwise have to be supplied by the injection of oxygen or other means. Laboratory and pilot plant tests have shown that constituents of the raw product gas thus produced are present in equilibrium concentrations at reaction conditions and consist primarily of hydrogen, carbon monoxide, carbon dioxide, methane and steam. It has been proposed to utilize steam gasification in the presence of a carbon-alkali metal catalyst to produce a high Btu product gas by treating the raw product gas for removal of steam and acid gases, principally carbon dioxide and hydrogen sulfide; cryogenically separating carbon monoxide and hydrogen in amounts equivalent to their equilibrium concentration in the raw product gas from the methane in the treated gas; withdrawing methane as a high Btu product gas; and recycling the carbon monoxide and hydrogen to the gasifier. The presence in the gasifier of the carbon-alkali metal catalyst and equilibrium quantities of recycle carbon monoxide and hydrogen, which tend to supress reactions that would otherwise produce additional hydrogen and carbon monoxide, results in a substantially thermoneutral reaction to produce essentially methane and carbon dioxide. Since the overall reaction is substantially thermoneutral, only a small heat input is required to preheat the carbonaceous feed material and to maintain the reactants at reaction temperatures by compensating for heat losses from the gasifier. This small amount of heat may be supplied by preheating the gaseous reactants in a conventional preheat furnace.

It has also been proposed to utilize steam gasification of a carbonaceous feed material in the presence of a carbon-alkali metal catalyst to produce an intermediate Btu product gas by treating the raw product gas withdrawn from the gasifier for the removal of steam and acid gases, principally carbon dioxide and hydrogen sulfide; recovering a portion of the treated gas as the intermediate Btu product gas; contacting the remainder of the treated gas with steam in a steam reformer under conditions such that the methane in the treated gas reacts with the steam to produce additional hydrogen and carbon monoxide; and passing the effluent from the reformer into the gasifier. The amounts of hydrogen and carbon monoxide produced in the reformer compensate for the amounts of those gases removed in the treated gas that is withdrawn as intermediate Btu product gas. Thus the reformer effluent will normally contain carbon monoxide and hydrogen in amounts equivalent to the equilibrium quantities of those gases present in the raw product gas and will therefore supply the substantially equilibrium quantities of hydrogen and carbon monoxide required in the gasifier along with the carbon-alkali metal catalyst and steam to produce the thermoneutral reaction that results in the formation of essentially methane and carbon dioxide.

SUMMARY OF THE INVENTION

This invention provides a process for the generation of a high purity chemical synthesis gas by the substantially thermoneutral reaction of steam with coal, petroleum coke, heavy oil, residuum and other carbonaceous feed materials in the presence of a carbon-alkali metal catalyst and added hydrogen and carbon monoxide. In accordance with the invention, it has now been found that a chemical synthesis gas can be generated by reacting steam with a carbonaceous feed material in a reaction zone at a temperature between about 1000° F. and about 1500° F. and a pressure in excess of about 100 psia, preferably between about 200 and about 800 psia, in the presence of a carbon-alkali metal catalyst and sufficient added hydrogen and carbon monoxide to provide substantially equilibrium quantities of hydrogen and carbon monoxide in the reaction zone at reaction temperature and pressure thereby producing a effluent gas consisting essentially of equilibrium quantities, at reaction temperature and pressure, of methane, carbon monoxide, carbon dioxide, steam and hydrogen; withdrawing the effluent gas from the reaction zone and treating it for the removal of steam and acid gases to produce a treated gas containing primarily carbon monoxide, hydrogen and methane; recovering carbon monoxide and hydrogen from the treated gas as a chemical synthesis product gas; contacting at least a portion of the remainder of the treated gas consisting primarily of methane with steam in a steam reforming zone under conditions such that at least a portion of the methane reacts with the steam to produce carbon monoxide and hydrogen; and passing the effluent from the reforming zone into the reaction zone.

It is normally desirable that the reforming zone effluent contain carbon monoxide and hydrogen in amounts equivalent to the equilibrium quantities of those gases present in the effluent gas withdrawn from the reaction zone so that the effluent from the steam reforming zone will supply the substantially equilibrium quantities of hydrogen and carbon monoxide required in the reaction zone along with the carbon-alkali metal catalyst and steam to produce the thermoneutral reaction that results in the formation of essentially methane and carbon dioxide. If the reforming zone effluent contains less than the desired amount of carbon monoxide and hydrogen, additional amounts of these gases may be added to the gasifier. Preferably, a slip stream of the chemical synthesis product gas is used for this purpose. If the reforming zone effluent contains more than the desired amount of carbon monoxide and hydrogen, the excess can be mixed with the reaction zone effluent, passed through the downstream processing scheme, and withdrawn as a portion of the chemical synthesis gas product.

A sufficient amount of steam is normally fed to the reforming zone so that enough unreacted steam is present in the steam reforming zone effluent to provide substantially all the steam necessary to supply the reactions taking place in the reaction zone. The reforming zone is normally operated at conditions such that its effluent may also be used to supply the heat needed to preheat the carbonaceous feed material to reaction temperature and compensate for heat losses from the reaction zone. This is normally achieved if the temperature of the reforming zone effluent is between about 100° F. and about 300° F. higher than the temperature in the reaction zone and the effluent is passed without substantial cooling into the reaction zone.

The process of the invention, unlike similar processes proposed in the past, utilizes the thermoneutral reaction of steam with a carbonaceous feed material to produce a high purity chemical synthesis gas that has wide spread industrial applications.

BRIEF DESCRIPTION OF THE DRAWING

The drawing is a schematic flow diagram of a process carried out in accordance with the invention for the manufacture of a chemical synthesis gas by the gasification of coal or similar carbonaceous solids with steam in the presence of a carbon-alkali metal catalyst and added equilibrium quantities of hydrogen and carbon monoxide.

DESCRIPTION OF THE PREFERRED EMBODIMENTS

The process depicted in the drawing is one for the production of a chemical synthesis gas by the gasification of bituminous coal, subbituminous coal, lignite, coal char, coke or similar carbonaceous solids with steam at a high temperature in the presence of a carbon-alkali metal catalyst prepared by impregnating the feed solids with a solution of an alkali metal compound or mixture of such compounds and thereafter heating the impregnated material to a temperature sufficient to produce an interaction between the alkali metal and the carbon present. The solid feed material that has been crushed to a particle size of about 8 mesh or smaller on the U.S. Sieve Series Scale is passed into line 10 from a feed preparation plant or storage facility that is not shown in the drawing. The solids introduced into line 10 are fed into a hopper or similar vessel 11 from which they are passed through line 12 into feed preparation zone 14. This zone contains a screw conveyor or similar device, not shown in the drawing, that is powered by a motor 16, a series of spray nozzles or similar devices 17 for the spraying of an alkali metal-containing solution supplied through line 18 onto the solids as they are moved through the preparation zone by the conveyor, and a similar set of nozzles or the like 19 for the introduction of a hot dry gas, such as flue gas, into the preparation zone. The hot gas, supplied through line 20, serves to heat the impregnated solids and drive off the moisture. A mixture of water vapor and gas is withdrawn from zone 14 through line 21 and passed to a condenser, not shown, from which water may be recovered for use as makeup or the like. The majority of the alkali metal-containing solution is recycled through line 49 from the alkali metal recovery portion of the process, which is described hereafter. Any makeup alkali metal solution required may be introduced into line 18 via line 13.

It is preferred that sufficient alkali metal-containing solution be introduced into preparation zone 14 to provide from about 1 to about 50 weight percent of an alkali metal compound or mixture of such compounds on the coal or other carbonaceous solids. From about 5 to about 30 percent is generally adequate. The dried impregnated solid particles prepared in zone 14 are withdrawn through line 24 and passed to a closed hopper or similar vessel 25 from which they are discharged through a star wheel feeder or equivalent device 26 in line 27 at an elevated pressure sufficient to permit their entrainment into a stream of high pressure steam, recycle product gas, inert gas or other carrier gas introduced into line 29 via line 28. The carrier gas and entrained solids are passed through line 29 into manifold 30 and fed from the manifold through feed lines 31 and nozzles, not shown in the drawing, into gasifier 32. In lieu of or in addition to hopper 25 and star wheel feeder 26, the feed system may employ parallel lock hoppers, pressurized hoppers, aerated standpipes operated in series, or other apparatus to raise the input feed solids stream to the required pressure level.

It is generally preferred to operate the gasifier 32 at a pressure between about 100 and 1500 psia, the most preferred range of operation being between about 200 and 800 psia. The carrier gas and entrained solids will normally be introduced at a pressure somewhat in excess of the gasifier operating pressure. The carrier gas may be preheated to a temperature in excess of about 300° F., but below the initial softening point of the coal or other feed material employed. Feed particles may be suspended in the carrier gas in a concentration between about 0.2 and about 5.0 pounds of solid feed material per pound of carrier gas. The optimum ratio for a particular system will depend in part upon the particle size and density, the molecular weight of the gas employed, the temperature of the solid feed material and the input gas stream, the amount of alkali metal compound employed and other factors. In general, ratios between about 0.5 and about 4.0 pounds of solid feed material per pound of carrier gas are preferred.

Gasifier 32 contains a fluidized bed of carbonaceous solids extending upward within the vessel above an internal grid or similar distribution device not shown in the drawing. The bed is maintained in the fluidized state by means of steam, hydrogen and carbon monoxide introduced through line 33, manifold 34 and peripherally spaced injection lines and nozzles 35 and through bottom inlet line 36. The particular injection system shown in the drawing is not critical and hence other methods for injecting the steam, hydrogen and carbon monoxide may be employed. In some instances, for example, it may be preferred to introduce the gases through multiple nozzles to obtain more uniform distribution of the injected fluid and reduce the possibility of channeling and related problems. The space velocity of the rising gases within the fluidized bed will normally be between about 2 and about 300 actual volumes of steam, hydrogen and carbon monoxide per hour per volume of fluidized solids.

Within the fluidized bed in gasifier 32, the carbonaceous solids impregnated with the alkali metal compound or mixture of such compounds are subjected to a temperature within the range between about 1000° F. and about 1500° F., preferably between about 1200° F. and 1400° F. At such a temperature the alkali metal constituents interact with the carbon in the carbonaceous solids to form a carbon-alkali metal catalyst, which will under proper reaction conditions equilibrate the gas phase reactions occurring during gasification to produce additional methane and at the same time supply substantial amounts of additional exothermic heat in situ. Due to the gas phase equilibrium conditions existing as a result of the carbon-alkali metal catalyst and due to the presence of equilibrium quantities of hydrogen and carbon monoxide injected with the steam near the lower end of the bed, the net reaction products will normally consist essentially of methane and carbon dioxide. Competing reactions that in the absence of the catalyst and the hydrogen and carbon monoxide would ordinarily tend to produce additional hydrogen and carbon monoxide are suppressed. At the same time, substantial quantities of exothermic heat are released as a result of the reaction of hydrogen with carbon oxides and the reaction of carbon monoxide with steam. This exothermic heat tends to balance the endothermic heat consumed by the reaction of the steam with carbon, thereby producing an overall thermoneutral reaction. So far as the heat of reaction is concerned, the gasifier is therefore largely in heat balance. The heat employed to preheat the feed coal to the reaction temperature and compensate for heat losses from the gasifier is supplied for the most part by excess heat in the gases introduced into the gasifier through lines 35 and 36. In the absence of the exothermic heat provided by the catalyzed gas phase reactions, these gases would have to be heated to substantially higher temperatures than those employed here.

The carbon-alkali metal catalyst utilized in the process of the invention is prepared by heating an intimate mixture of carbon and an alkali metal constituent to an elevated temperature, preferably above 800° F. In the process shown in the drawing and described above, the intimate mixture is prepared by impregnating the carbonaceous feed material with an alkali metal-containing solution and then subjecting the impregnated solids to a temperature above 800° F. in the gasifier itself. It will be understood that the alkali metal catalyst utilized in the process of this invention can be prepared without impregnation onto the carbonaceous solids to be gasified, and without heating in the gasifier. The heating step, for example, may be carried out in a solid feed preparation zone or in an external heater. The carbonaceous solids used will in most instances be the ones which are to be gasified but in some variations of the process carbonaceous materials other than the feed solids may be used. In some cases inert carriers having carbon deposited on their outer surface may be used. Suitable inert carriers include silica, alumina, silica-alumina, zeolites, and the like. The catalyst particles, whether composed substantially of carbon and an alkali metal constituent or made up of carbon and an alkali metal constituent deposited on an inert carrier, may range from fine powders to coarse lumps, particles between about 4 and about 100 mesh on the U.S. Sieve Series Scale generally being preferred. The size selected for use in a particular operation will normally depend in part on the gas velocities and other conditions within the system in which the catalyst is to be used. In fluidized bed systems, the particle size is in part dependent upon the conditions under which the bed is to be operated. In fixed or moving bed systems, the catalyst particle size is generally of less importance.

Any of a variety of alkali metal constituents can be used in preparing the carbon-alkali metal catalyst. Suitable constituents include the alkali metals themselves and alkali metal compounds such as alkali metal carbonates, bicarbonates, formates, biphosphates, oxalates, amides, hydroxides, acetates, sulfates, hydrosulfates, sulfides, and mixtures of these and other similar compounds. All of these are not equally effective and hence a catalyst prepared from certain alkali metal constituents can be expected to give somewhat better results under certain conditions than do others. In general, cesium, potassium, sodium and lithium salts derived from organic or inorganic acids having ionization constants less than about $1\times10^{-3}$ and alkali metal hydroxides are preferred. The cesium compounds are the most effective, followed by the potassium, sodium and lithium compounds in that order. Because of their high activity, relatively low cost compared to cesium compounds, and ready availability, potassium compounds or sodium compounds are generally employed. Potassium carbonate and potassium hydroxide are especially effective.

In the embodiment of the invention shown in the drawing, the alkali metal constituent and the carbonaceous solids are combined to form an intimate mixture by dissolving a water soluble alkali metal compound in an aqueous carrier, impregnating the carbonaceous solid with the resulting aqueous solution by soaking or spraying the solution onto the particles, and thereafter drying the solids. It will be understood that other methods of forming such an intimate mixture may be used. For example, in some cases the carbonaceous material can be impregnated by suspending a finely divided alkali metal or alkali metal compound in a hydrocarbon solvent or other inert liquid carrier of suitably low viscosity and high volatility and thereafter treating the solids with the liquid containing the alkali metal constituent. In other cases, it may be advantageous to pelletize a very finely divided alkali metal or alkali metal compound with carbon in an oil or similar binder and then heat the pellets to an elevated temperature. Other catalyst preparation methods, including simply mixing finely divided carbonaceous material with a powdered alkali metal salt and thereafter heating the mixture to the desired temperature, can in some cases also be used.

The mechanisms which take place as the result of combining the carbonaceous solids and alkali metal constituents and then heating them to elevated temperatures are not fully understood. Apparently, the alkali metal reacts with the carbon to form carbon-alkali metal compounds and complexes. Studies have shown that neither carbonaceous solids nor the alkali metal constituents alone are fully effective for establishing equilibrium conditions for gas phase reactions involving steam, hydrogen, carbon monoxide, carbon dioxide and methane and that catalytic activity is obtained only when a compound or complex of the carbon and alkali metal is present in the system. Both constituents of the catalyst are therefore necessary. Experience has shown that these catalysts are resistent to degradation in the presence of sulfur compounds, that they resist sintering at high temperatures, and that they bring gas phase reactions involving the gases normally produced during coal gasification into equilibrium. As a result of these and other beneficial properties, these catalysts have pronounced advantages over other catalysts employed in the past.

Referring again to the drawing, the gas leaving the fluidized bed in gasifier 32 passes through the upper section of the gasifier, which serves as a disengagement zone where the particles too heavy to be entrained by the gas leaving the vessel are returned to the bed. If desired, this disengagement zone may include one or more cyclone separators or the like for removing relatively large particles from the gas. The gas withdrawn from the upper part of the gasifier through line 37 will normally contain an equilibrium mixture at reaction temperature and pressure of methane, carbon dioxide, hydrogen, carbon monoxide, and unreacted steam. Also present in this gas are hydrogen sulfide, ammonia and other contaminants formed from the sulfur and nitrogen contained in the feed material, and entrained fines. This raw product gas is introduced into cyclone separator or similar device 38 for removal of the larger fines. The overhead gas then passes through line 39 into a second separator 41 where smaller particles are removed. The gas from which the solids have been separated is taken overhead from separator 41 through line 42 and the fines are discharged downward through dip legs 40 and 43. These fines may be returned to the gasifier or passed to the alkali metal recovery portion of the process.

In the system shown in the drawing, a stream of high ash content char particles is withdrawn through line 44 from gasifier 32 in order to control the ash content of the system and permit the recovery and recycle of alkali metal constituents of the catalyst. The solids in line 44, which may be combined with fines recovered from the gasifier overhead gas through dip legs 40 and 43 and line 45, are passed to alkali metal recovery unit 46. The recovery unit will normally comprise a multistage countercurrent leaching system in which the high ash content particles are countercurrently contacted with water introduced through line 47. An aqueous solution of alkali metal compounds is withdrawn from the unit through line 48 and recycled through lines 49 and 18 to feed preparation zone 14. Ash residues from which soluble alkali metal compounds have been leached are withdrawn from the recovery unit through line 50 and may be disposed of as land fill or further treated to recover added alkali metal constituents.

The gas leaving separator 41 is passed through line 42 to gas-gas heat exchanger 51 where it is cooled by indirect heat exchange with a gaseous mixture of methane and steam introduced through line 77. The cooled gas is then passed through line 53 into waste heat boiler 54 where it is further cooled by indirect heat exchange with water introduced through line 55. Sufficient heat is transferred from the gas to the water to convert it into steam, which is withdrawn through line 56. During this cooling step, unreacted steam in the gas from exchanger 51 is condensed out and withdrawn as condensate through line 57. The cool gas exiting waste heat boiler 54 through line 58 is passed to water scrubber 59. Here the gas stream passes upward through the scrubber where it comes in contact with water injected into the top of the scrubber through line 60. The water absorbs ammonia and a portion of the hydrogen sulfide in the gas stream and is withdrawn from the bottom of the scrubber through line 61 and passed to downstream units for further processing. The water scrubbed gas stream is withdrawn from the scrubber through line 62 and is now ready for treatment to remove bulk amounts of hydrogen sulfide and other acid gases.

The gas stream is passed from water scrubber 59 through line 62 into the bottom of solvent scrubber 63. Here the gas passes upward through the contacting zone in the scrubber where it comes in contact with a downflowing stream of solvent such as monoethanolamine, diethanolamine, a solution of sodium salts of amino acids, methanol, hot potassium carbonate or the like introduced into the upper part of the solvent scrubber through line 64. If desired, the solvent scrubber may be provided with spray nozzles, perforated plates, bubble cap plates, packing or other means for promoting intimate contact between the gas and the solvent. As the gas rises through the contacting zone, hydrogen sulfide, carbon dioxide and other acid gases are absorbed by the solvent, which exists the scrubber through line 65. The spent solvent containing carbon dioxide, hydrogen sulfide and other contaminants is passed through line 65 to a stripper, not shown in the drawing, where it is contacted with steam or other stripping gas to remove the absorbed contaminants and thereby regenerate the solvent. The regenerated solvent may then be reused by injecting it back into the top of the scrubber via line 64.

A clean gas containing essentially methane, hydrogen, and carbon monoxide in amounts substantially equivalent to the equilibrium quantities of those gases in the raw product gas withdrawn from gasifier 32 through line 37 is withdrawn overhead from the solvent scrubber via line 66. The methane content of the gas will normally range between about 20 and about 60 mole percent and the gas will be of an intermediate Btu heating value, normally containing between about 400 and about 750 Btu's per standard cubic foot.

The intermediate Btu gas withdrawn overhead from solvent scrubber 63 through line 66 is introduced into heat transfer unit 67 where it passes in indirect heat exchange with liquid methane introduced through line 68. The methane vaporizes within the heat transfer unit and is discharged as methane gas through line 69. The vaporizing methane chills the intermediate Btu gas, which is primarily composed of methane, hydrogen and carbon monoxide, to a low temperature approaching that required for liquefaction of the methane contained in the gas, after which the chilled gas is passed through line 70 into cryogenic unit 71. Here the gas is further cooled by conventional means until the temperature reaches a value sufficiently low to liquefy the methane under the pressure conditions existing in the unit. Compressors and other auxiliaries associated with the cryogenic unit are now shown. The amount of pressure required for the liquefaction step will depend in part upon the pressure at which the gasifier is operated and the pressure losses which are incurred in the various portions of the system. A substantially pure stream of liquefied methane is taken off through line 72 and passed through line 68 into heat transfer unit 67 as described earlier. Hydrogen and carbon monoxide are withdrawn overhead from cryogenic unit 71 through line 80 and recovered as a chemical synthesis product gas. Normally, the cryogenic unit is operated and designed in such a manner that less than about 10 mole percent of methane, preferably less than about 5 mole percent, remains in the product gas removed through line 80. Thus, the chemical synthesis gas produced in the process is one of extremely high purity and therefore has many industrial applications.

The recycle methane gas removed from heat transfer unit 67 through line 69 is passed to compressor 73 where its pressure is increased to a value from about 25 psi to about 150 psi above the operating pressure in gasifier 32. The pressurized gas is withdrawn from compressor 73 through line 74 and passed through tubes 75 located in the convection section of steam reforming furnace 76. Here, the high pressure gas picks up heat via indirect heat exchange with the hot flue gases generated in the furnace. The methane gas is removed from the tubes 75 through line 77 and mixed with steam, which is generated in waste heat boiler 54 and injected into line 77 via line 56. The mixture of methane gas and steam is then passed through line 77 into gas-gas heat exchanger 51 where it is heated by indirect heat exchange with the raw product gas removed from separator 41. The heated mixture is removed from exchanger 51 and passed through line 78 to steam reforming furnace 76.

The preheated mixture of steam and methane gas in line 78 is introduced into the inernal tubes 79 of the steam reforming furnace where the methane and steam react with one another in the presence of a conventional steam reforming catalyst. The catalyst wll normally consist of metallic constituents supported on an inert carrier. The metallic constituent will normally be selected from Group VI-B and the iron group of the Periodic Table and may be chromium, molybdenum, tungsten, nickel, iron, and cobalt, and may include small amounts of potassium carbonate or a similar compound as a promoter. Suitable inert carriers include silica, alumina, silica-alumina, zeolites, and the like.

The reforming furnace is operated under conditions such that the methane in the feed gas will react with steam in the tubes 79 to produce hydrogen and carbon monoxide according to the following equation:

$$H_2O + CH_4 \rightarrow 3H_2 + CO$$

The temperature in the reforming furnace will normally be maintained between about 1200° F. and about 1800° F., preferably between about 100° F. and about 300° F. above the temperature in gasifier 32. The pressure will range between about 10 and about 30 psi above the pressure in the gasifier. The mole ratio of steam to methane introduced into the reactor will range between about 2:1 and about 15:1, preferably between about 3:1 and about 7:1. The reforming furnace may be fired by a portion of the methane gas removed from heat transfer unit 67 via line 69, a portion of the intermediate Btu gas removed from solvent scrubber 63 through line 66, or a similar fuel gas.

The gaseous effluent stream from the steam reforming furnace, which will normally be a mixture consisting primarily of hydrogen, carbon monoxide, and unreacted steam, is passed, preferably without substantial cooling, through lines 81, 36, and 33 into gasifier 32. This stream is the primary source of the hydrogen, carbon monoxide, and steam required in the gasifier in addition to the carbon-alkali metal catalyst to produce the thermoneutral reaction that results in the formation of essentially carbon dioxide and methane. It is therefore desirable that the reforming furnace effluent contain sufficient carbon monoxide and hydrogen to supply the substantially equilibrium quantities of those gases required in the gasifier and sufficient unreacted steam to provide substantially all of the steam required by the reactions taking place in the gasifier.

As pointed out previously, substantial quantities of exothermic heat are released in the gasifier as a result of the reaction of hydrogen with carbon oxides and the reaction of carbon monoxide with steam. Thus, the carbon monoxide and hydrogen in the reformer effluent stream comprises a substantial portion of the heat input into the gasifier. To supply the desired amounts of hydrogen and carbon monoxide in the effluent, sufficient methane should normally be present in the feed to the reforming furnace so that enough carbon monoxide and hydrogen is produced by steam reforming the methane to compensate for the amount of hydrogen and carbon monoxide removed in the chemical synthesis product gas withdrawn from the process overhead of cryogenic unit 71 through line 80. If there is insufficient methane in the feed to the reforming furnace, the conditions in the gasifier may be altered so that additional methane is produced in the raw product gas. Alternatively, a slip stream of the chemical synthesis product gas may be used to make up any deficiency in the amounts of carbon monoxide and hydrogen required. If, on the other hand, there is more than the desired amount of methane in the feed to the reforming furnace, the conditions in the gasifier may be altered to decrease the amount of methane produced in the raw product gas, the excess methane may be withdrawn as a byproduct stream from line 74 prior to subjecting it to steam reforming, or the excess methane may be reformed to produce additional carbon monoxide and hydrogen that can be passed from line 81 into line 42 and recycled through the downstream portion of the process. If the amount of steam added via line 56 to the reforming furnace feed stream in line 78 is not sufficiently in excess of the amount consumed in the furnace so as to provide the desired quantity of unreacted steam in the reformer effluent, additional steam may be injected into line 78 through line 82.

For the purposes of thermal efficiency, it is preferable that the steam reforming step of the process be utilized in such a manner as to obviate the need for a separate preheat step. This may be achieved by operating the reforming furnace so that the heat content of the effluent is sufficient to preheat the carbonaceous feed material to reaction temperature and maintain all of the reactants at such temperature by compensating for heat losses during gasification. Normally, this may be accomplished if the temperature of the effluent is between about 100° F. and about 300° F. higher than the operating temperature in the gasifier. For optimum thermal efficiency it is important that the effluent from the steam reforming furnace be passed to the gasifier in such a manner as to avoid substantial cooling. As used herein "heat content" refers to the sum of the heats of formation plus the sum of the sensible heats for each component in the reforming furnace effluent.

It will be apparent from the above discussion that the effluent from the reforming furnace 76 will supply substantially all of the heat required in gasifier 32. The effluent will not only contain sufficient sensible heat to preheat the carbonaceous feed material to reaction temperature and maintain all the reactants at such temperature by compensating for heat losses during gasification, but it will also contain sufficient amounts of carbon monoxide and hydrogen which react in the gasifier to produce enough exothermic heat to substantially balance the endothermic heat consumed by the reaction of the steam with carbon.

It will be apparent from the foregoing that the invention provides a process for producing a high purity chemical synthesis gas from the steam gasification of a carbonaceous material such as coal in the presence of a carbon-alkali metal catalyst and substantially equilibrium quantities of added hydrogen and carbon monoxide. The process of the invention has advantages over existing coal gasification processes that may be used to generate a chemical synthesis gas in that its gasifier operates at lower temperature, it is more energy efficient, and it does not require the injection of oxygen to supply heat, thereby obviating the need for an expensive oxygen plant.

We claim:

1. A process for the production of a chemical synthesis product gas from a carbonaceous feed material and steam which comprises:

(a) reacting said steam with said carbonaceous feed material in a reaction zone at a reaction temperature between about 1000° F. and about 1500° F. and at a reaction pressure in excess of about 100 psia, in the presence of a carbon-alkali metal catalyst and sufficient added hydrogen and carbon monoxide to provide substantially equilibrium quantities of hydrogen and carbon monoxide in said reaction zone at said reaction temperature and said reaction pressure;

(b) withdrawing from said reaction zone an effluent gas containing substantially equilibrium quantities, at said reaction temperature and pressure, of methane, carbon dioxide, steam, hydrogen and carbon monoxide;

(c) treating said effluent gas for the removal of steam and acid gases to produce a treated gas containing primarily carbon monoxide, hydrogen and methane;

(d) recovering substantially all of the carbon monoxide and hydrogen from said treated gas as a chemical synthesis product gas, thereby producing a gas comprised substantially of methane;

(e) contacting the gas produced in step (d) comprised substantially of methane with steam in a steam reforming zone under conditions such that at least a portion of the methane present reacts with said steam to produce hydrogen and carbon monoxide; and (f) passing the effluent from said steam reforming zone into said reaction zone without substantial cooling, thereby supplying said added hydrogen and carbon monoxide required in said reaction zone and wherein said reforming zone is operated at conditions such that the heat content of said effluent from said steam reforming zone is sufficient to supply substantially all of the heat needed to preheat said carbonaceous feed material to said reaction temperature.

2. A process as defined by claim 1 wherein said carbonaceous feed material comprises coal.

3. A process as defined by claim 2 wherein said carbon-alkali metal catalyst is prepared by treating said coal with an alkali metal compound and thereafter heating the treated coal to said reaction temperature in said reaction zone.

4. A process as defined by claim 1 wherein said chemical synthesis product gas contains less than about 10 mole percent methane.

5. A process as defined by claim 1 wherein said reaction temperature is between about 1200° F. and about 1400° F.

6. A process as defined by claim 1 wherein said reaction pressure is between about 200 psia and about 800 psia.

7. A process as defined by claim 1 wherein sufficient steam is contacted with said methane in said steam reforming zone so that the effluent from said zone will contain enough unreacted steam to supply substantially all the steam required in said reaction zone.

8. A process for the production of a chemical synthesis product gas from coal and steam which comprises:

(a) gasifying said coal with steam in a catalytic gasification zone at a reaction temperature between about 1000° F. and about 1500° F. and at a reaction pressure between about 200 psia and about 800 psia, in the presence of a carbon-alkali metal catalyst comprising a high temperature carbon-alkali metal reaction product, and in the presence of sufficient added hydrogen and carbon monoxide to provide substantially equilibrium quantities of hydrogen and carbon monoxide in said catalytic gasification zone at said reaction temperature and said reaction pressure;

(b) withdrawing from said catalytic gasification zone a raw product gas containing substantially equilibrium quantities, at said reaction temperature and pressure, of methane, carbon dioxide, steam, hydrogen and carbon monoxide;

(c) treating said raw product gas for the removal of steam and acid gases to produce a treated gas containing primarily carbon monoxide, hydrogen and methane;

(d) recovering substantially all of the carbon monoxide and hydrogen from said treated gas as a chemical synthesis product gas, thereby producing a gas comprised substantially of methane;

(e) contacting the gas produced in step (d) comprised substantially of methane with excess steam in a steam reforming zone under conditions such that the methane reacts with a portion of said excess steam to produce sufficient hydrogen and carbon monoxide so that the effluent from said steam reforming zone will contain said added hydrogen and carbon monoxide required in said catalytic gasification zone, said excess steam being present in such a quantity that said effluent will also contain enough unreacted steam to supply substantially all of the steam requirements in said catalytic gasification zone, and wherein said steam reforming zone is operated at conditions such that the heat content of said effluent is sufficient to supply substantially all of the heat needed to preheat said coal to said reaction temperature; and (f) passing said effluent from said steam reforming zone into said catalytic gasification zone without substantial cooling.

9. A process as defined by claim 8 wherein the temperature of said effluent from said steam reforming zone is between about 100° F. and about 300° F. higher than said reaction temperature in said catalytic gasification zone.

10. A process a defined by claim 8 wherein said coal is impregnated with an aqueous solution of a potassium compound and dried prior to the introduction of said coal into said catalytic gasification zone.

11. A process as defined by claim 10 wherein said aqueous solution comprises alkali metal compounds recovered from char withdrawn from said catalytic gasification zone.

* * * * *